US005691286A

United States Patent [19]

Stepan

[11] Patent Number: 5,691,286

[45] Date of Patent: Nov. 25, 1997

[54] ENVIRONMENTALLY FRIENDLY SUGAR MILL BEARING LUBRICANT

[75] Inventor: Robert J. Stepan, Strongsville, Ohio

[73] Assignee: Dylon Industries Inc., Cleveland, Ohio

[21] Appl. No.: 730,098

[22] Filed: Oct. 15, 1996

[51] Int. Cl.[6] ..... C10M 129/68; C10M 159/02

[52] U.S. Cl. ..... 508/491; 508/115; 508/216; 508/449; 508/451

[58] Field of Search ..... 508/491, 115, 508/216, 449, 451

[56] References Cited

U.S. PATENT DOCUMENTS

| | | | |
|---|---|---|---|
| 3,098,823 | 7/1963 | Morway | 508/449 |
| 3,740,333 | 6/1973 | Hutchinson | 508/491 |
| 4,011,385 | 3/1977 | Wang et al. | 526/190 |
| 4,077,905 | 3/1978 | Wang et al. | 502/154 |
| 4,105,837 | 8/1978 | Prosser | 525/333.7 |
| 4,115,282 | 9/1978 | Grasshoff | 508/216 |
| 4,670,174 | 6/1987 | Mirkin | 508/491 |
| 4,740,324 | 4/1988 | Schur | 508/449 |
| 4,754,848 | 7/1988 | Azzopardi et al. | 184/6.26 |
| 4,808,324 | 2/1989 | Périard et al. | 508/115 |
| 5,338,471 | 8/1994 | Lal | 508/491 |
| 5,358,652 | 10/1994 | Macpherson | 508/491 |
| 5,372,736 | 12/1994 | Trivett | 508/491 |
| 5,380,469 | 1/1995 | Flider | 508/491 |
| 5,413,725 | 5/1995 | Lal et al. | 508/491 |
| 5,473,002 | 12/1995 | Gardiner et al. | 524/188 |
| 5,489,394 | 2/1996 | Ford et al. | 510/245 |
| 5,618,779 | 4/1997 | Klein et al. | 508/486 |

*Primary Examiner*—Ellen M. McAvoy

[57] ABSTRACT

An environmentally safe sugar mill journal bearing lubricant for use in the processing of sugar cane. The sugar mill journal bearing lubricant comprises a major amount of chewing gum base derived from synthetic or natural products to prevent metal to metal contact, and an edible triglyceride oil such as lard or canola oil. Additionally, a minor amount of high molecular weight polybutene, a USDA authorized extreme pressure additive, and/or an polymeric tackifier for increasing film strength and providing boundary lubrication may be included in the lubricant.

25 Claims, No Drawings

ENVIRONMENTALLY FRIENDLY SUGAR MILL BEARING LUBRICANT

FIELD OF THE INVENTION

The invention relates to a lubricant for use in lubricating the journal bearings which support the rolls of a sugar mill which are used to crush sugar cane in the production of sugar and more particularly to an environmentally safe lubricant which is formed from materials which are USDA and/or FDA registered as food additives and/or approved for food contact and which includes a natural or synthetic gum as a primary component.

BACKGROUND OF THE INVENTION

For centuries sugar cane has been milled into a consumable sugar product. Nationally, Florida and Louisiana are the primary sugar producing states. The chief mode for the production of sugar in the last 50 years has been by rolling the cane. The rolls that process the cane are supported on journal bearings and must exert large amounts of pressure at the roll interface to crush the cane. It is this force that is distributed mainly through sugar mill journal bearings. The entire cane crushing operation is typically located outdoors within close proximity to the sugar cane fields. Therefore, any by-product or waste from the sugar mill impacts on the environment and may contaminate the sugar being produced.

Prior art lubrication of the sugar mill journal bearings include the use of asphalt and 1,1,1-trichloroethane (also known as methyl chloroform, hereinafter referred to as trichloroethane) based lubricants. These materials are the current industry standard. They are tacky, black, carcinogenic, very hazardous to the environment, do not readily biodegrade, and do not efficiently maintain a barrier between the journal and bearing surfaces. The EPA (Environmental Protection Agency) monitors the sugar mill industry because of the bearing lubricant's impact on the environment. Thus, there is a need for a clean, environmentally friendly, lubricant in this industry.

The use of asphalt and trichloroethane to lubricate sugar mill journal bearings has several drawbacks, the most important of which is the severe impact on the environment. Asphalt contains materials that may cause cancer and trichloroethane has been connected to ozone depletion and is strictly regulated by the U.S. government.

Typically, the asphalt and trichloroethane based materials are pumped through a Farvel type pump system to the journal bearing. Much of the lubricant is wasted and ultimately finds its way out of the bearing and onto the ground. This causes the sugar mill to be covered in black tacky asphalt. At the ground site there are copious amounts of water, juice and bagasse (a by-product of the cane rolling process). The water, juice and bagasse mix with the asphalt and trichloroethane based lubricant which may ultimately find its way out of the bearing and pass into natural or artificial water run-off system. The formation of this bagasse-asphalt slurry further exacerbates the environmental dilemma. Asphalt based lubricants possess very poor biodegradability. Once on the ground these lubricants can remain an environmental hazard for centuries. Thus, it is desirable to provide an environmentally safe, biodegradable, non-toxic, and efficient lubricant for use in a sugar mill journal bearing which if it comes in contact with the juice will not contaminate the juice with toxic or harmful chemicals.

The lubricant of the present invention is designed to provide lubrication to very large journal bearings of a sugar mill which are under extreme pressure. The lubricant seals out water, juice and bagasse that surround the bearing and provides superior protection against wear and corrosion.

The lubricant of the present invention includes as its primary component FDA and/or USDA registered chewing gum base which material is a clear liquid, is non-toxic, and biodegradable. It has been found that the use of a chewing gum base as a primary component of the lubricant provides a barrier to prevent metal to metal contact in the bearing and extends the service life of the bearing compared to prior art lubricant. In addition, because of its greater efficiency as a lubricant component in contrast to the prior art asphalt and trichloroethane lubricants, the amount of the lubricant of the lubricant of the present invention required to lubricate the bearing is much less than the prior art lubricants. Less lubricant used, especially an environmentally safe lubricant, means less impact on the environment. The lubricant of the present invention has been found to stabilize and lower the temperature of the bearing as compared to the prior art lubricant where the bearing temperature is higher and fluctuates within a wide temperature range. The temperature fluctuation causes thermal fatigue which results in early bearing failure. The present lubricant reduces the maintenance required by the bearings by keeping bearing temperatures consistently stable and low.

SUMMARY OF NEW INVENTION

The present invention provides a new and improved journal bearing lubricant which is particularly adapted to lubricate the journal bearings of a sugar mill while having an extremely low environmental impact. In addition, the lubricant comprises materials which will not contaminate the sugar juice with toxic materials in the event some of the lubricant mixes with the juice. This is accomplished by utilizing Food and Drug Administration (FDA) and/or United States Department of Agriculture (USDA) materials which are authorized for use as food additives or food contact materials like chewing gums and edible tackifiers.

A further provision of the present invention is to minimize the impact on the water and ground by making the sugar mill journal bearing lubricant extremely biodegradable. Biodegradability is measured by two tests, the Chemical Oxygen Demand Analysis (COD) and Biological Oxygen Demand Analysis (BOD). The higher the number given from these tests, the more oxygen required to decompose the material and the more damaging the material is to the environment. The new lubricant displays one-fortieth the COD of the prior art asphalt and trichloroethane based materials.

Still another provision of the present invention is to provide a superior lubricant which reduces lubricant consumption compared to the prior art lubricants. Tests have demonstrated that the new lubricant of the present invention reduces the usage level by almost 90% compared to prior art lubricants. This significantly lowers waste and environmental impact.

The lubricant of the present invention provides a lubricant that will increase the life of the journal race and bearing by preventing metal to metal contact in the journal bearing.

The present invention provides a new and improved environmentally safe journal bearing lubricant for lubricating a sugar mill journal bearing, including (a) 10–92 percent by weight of a synthetic or natural gum or a natural coagulated or concentrated lattice of a vegetable origin which functions as a biodegradable lubricant to prevent metal to metal contact in the bearing, and (b) 2–15 percent by weight of a triglyceride oil made from a natural vegetable oil and/or animal oil for increasing film strength and boundary lubrication.

Another provision of the present invention is to provide an environmentally safe journal bearing lubricant as set forth in the preceding paragraph, further including 1–43 percent by weight of a high molecular weight polybutene having a molecular weight of at least 2,300.

Still another provision of the present invention is to provide an environmentally safe journal bearing lubricant suitable for lubricating a sugar mill journal bearing, including (a) 10–92 percent by weight of a USDA and/or FDA registered synthetic or natural chewing gum which functions as a biodegradable lubricant to prevent bearing to bearing journal contact selected from the group consisting of alpha-pinene, beta-pinene, and polyvinyl acetate having a minimum molecular weight of 2,000 and mixtures thereof, (b) 1–10 percent by weight of the USDA registered triglyceride oil made from a natural vegetable oil and/or animal oil for increasing the film strength and boundary lubrication selected from the group consisting of the group lard oil, soybean oil, canola oil, high euricic acid rapeseed oil, corn oil, sunflower oil, fish oil, epoxidized soybean oil, medium chain fatty acid propylene gylcol esters, castor oil and mixtures thereof, (c) 1–5 percent by weight of USDA registered polybutene having an average molecular weight of between 2,300 and 20,000, (d) 1.0 to 5 percent by weight of one or more of USDA registered lubricant additives for lowering friction under extreme load conditions and retarding oxidation and corrosion, and (e) 0–2 percent by weight of a USDA registered viscosity index improver selected from the group consisting of high molecular weight polybutene having an average molecular weight of at least 60,000, polyisobutylene, polyethylene, polypropylene, and/or a block polymer comprised of polyethylene and polypropylene and mixtures thereof.

Still another provision of the present invention is to provide a new and improved environmentally safe journal bearing lubricant suitable for lubrication of a sugar mill journal bearing comprising of (a) 75–90 percent by weight of a USDA and/or FDA registered natural chewing gum base for preventing bearing to journal contact, (b) 1–5 percent by weight of one or more USDA registered polybutenes having an average molecular weight of between 2,300 and 20,000, (c) 1–10 percent by weight of a USDA oil based on paraffin or paraffin based stock for imparting high temperature hydrodynamic lubrication, (d) 1.5–3 percent by weight of one or more USDA registered lubricant additives for protecting bearing surfaces from extreme pressure, wear, and corrosion, (e) 0.5–1 percent by weight of a USDA registered viscosity index improver, and (f) 1–10 percent by weight of a USDA registered triglyceride oil made from natural vegetable oil, animal oil or vegetable oil and mixtures thereof for increasing film strength and boundary lubrication.

DESCRIPTION OF THE INVENTION

The lubricant of the present invention provides a sugar mill journal bearing lubricant based on natural ingredients that is clean and environmentally safe. The lubricant reduces lubricant consumption, reduces operating temperatures, reduces bearing wear, and extends bearing service life.

This is accomplished with a lubricant composed of:

(a) 10 to 92 percent by weight of a USDA and/or FDA registered natural chewing gum base (FDA, CFR title 21, 172.615);

(b) 0 to 43 percent by weight of one or more USDA registered polybutenes;

(c) 0 to 39 percent by weight of a USDA registered paraffinic base stock;

(d) 0 to 5.0 percent by weight of a one or more USDA registered lubricant additives;

(e) 0 to 2 percent by weight of a USDA registered viscosity index improver; and (f) 1 to 15 percent by weight of a USDA registered triglyceride oil made from natural products;

Preferably the sugar mill bearing lubricant consists of:

(a) 75 to 90 percent by weight of a USDA and/or FDA registered natural chewing gum base (FDA, CFR title 21, 172.615);

(b) 1 to 5 percent by weight of one or more USDA registered polybutenes;

(c) 1 to 10 percent by weight of a USDA registered paraffinic base stock;

(d) 1.5 to 3.0 percent by weight of a one or more USDA registered lubricant additives;

(e) 0.50 to 1 percent by weight of a USDA registered viscosity index improve; and (f) 1 to 10 percent by weight of a USDA registered triglyceride oil made from natural products.

A primary component of the lubricant of the present invention is chewing gum base. A natural base is preferred. However, those that are acceptable for use include both synthetic and natural gums consisting of alpha-pinene and/or beta-pinene and natural coagulated or concentrated lattices of vegetable origin. Preferably the lubricant includes 75 to 90 percent by weight of a chewing gum base but ranges from 10 to 92 percent by weight have been found acceptable. Below 10% by weight the material shows minimal effect on the lubricant's performance. Increasing the level of the gum base enhances the lubricant's load bearing properties as well as water resistance and tack. The synthetic and natural gums preferably have a saponification number less than 5, and a color less than 4 (Gardner Scale). In addition the softening point is preferred to be from 155° C. to 210° C. (as determined by United States Pharmacopoeia (USP) closed capillary method). This material is distinguished by superior lubricating film strength which prevents metal to metal contact with the bearing combined with water resistance, biodegradability, light color and FDA registry.

From the pinene group it is necessary that the material possess a solubility such that it is not soluble in water. It is also necessary that the pinene group material have enough polarity to be water resistant and enable it to perform as a boundary lubricant. However, the pinene group material should not be so polar that it loses its resistance to water and mill juice. The pinene group material provides lower friction thereby reducing the heat and wear of the journal bearing.

In place of a synthetic or natural gum a natural coagulated or concentrated lattices of vegetable origin could be used to provide lubricating film to prevent metal to metal contact. Examples of these would be chicle, crown gum, nispero, rosindha, natural rubber (smoked sheet and latex), hydrophobic derivatives of the glycerol ester based on tall oil, glycerol ester of wood rosin, and rice bran wax.

Examples of synthetic gums that can be used are FDA registered 21 CFR-172.615 synthetic gums such as seed wax, petroleum wax and polyvinyl acetate (molecular weight 2,000).

The use of the terms "FDA registered" and/or "USDA registered" refers to materials which are registered with the Federal Drug Administration and the United States Department of Agriculture as materials authorized for use as food additives and/or for food contact. The USDA is responsible for the maintenance of safe and sanitary conditions in plants which produce food and food additives. These agencies call for the authorization of the use of substances and compounds in the plants, because misuse of such products may result in adulteration or unwholesomeness of food being processed. Compounds whose use is proposed in such plants are evaluated and authorized, where appropriate, as safe compounds. All chemicals produced anywhere in the United States for marketing to federally inspected meat and poultry plants must be evaluated by the USDA. In addition, chemicals produced outside the United States for marketing to U.S. plants or to plants exporting meats or poultry products to the United States may require such evaluation. Chemicals used in other food industries must also be evaluated to insure that the chemicals are authorized for use in food or for food contact and that their proper use will not result in the adulteration or contamination of food products. Food additives include all substances the intended use of which results or may reasonably be expected to result, directly or indirectly, either in their becoming a component of food or otherwise affecting the characteristics of food. The FDA and/or USDA defines "safe" as meaning that there is a reasonable certainty in the minds of competent scientists that the substance is not harmful under the intended conditions of use. While FDA and/or USDA authorized compounds are disclosed in the present application, it should be appreciated that other compounds and/or chemicals may be subsequently authorized by the USDA and/or FDA which have the same properties as compounds enumerated herein, and those compounds and/or chemicals should be included within the scope of the present invention. The purpose of FDA and/or USDA registry is to insure that food or food products are not adulterated or contaminated and other chemicals and/or compounds which are not presently FDA and/or USDA registered, but which have equivalent characteristics and which do not contaminate and/or adulterate food products should be considered within the scope of the present invention.

An additional component of the lubricant may be polybutene. Preferably the lubricant includes 1 to 5 percent by weight polybutene as an extreme pressure based lubricant. However, ranges of 0 to 43 percent by weight have been found to be acceptable. The addition of polybutene to the lubricant increases its thermal stability and water resistance and prevents metal to metal contact in the journal bearing. The polybutene should preferably possess an average molecular weight of 2,300 to 20,000. This material will preferably comply with FDA Title 21, CFR 178.1430, FDA Title 21, CFR 178.3570 and FDA Title 21, CFR 178.3910.

Furthermore, the polybutene should preferably possess a flash point above 470° F. using the Cleveland Open Cup method. Other polymers that may be used for this application are those that comply with the above said FDA regulations. Those that are particularly acceptable are polyethylene, polyisobutylene, and polymers based on polystyrene.

The invention may also include a natural vegetable or animal oil. Preferably 1 to 10 percent by weight of a USDA registered triglyceride oil made from natural products is used, although as much as 15 percent by weight can be used in the present lubricant. These oils provide increased film strength and boundary lubrication while lowering the environmental impact of the lubricant. These materials also possess high temperature stability which allows them to maintain film strength throughout varied bearing temperatures. These oils should be of the naturally occurring triglyceride type and possess food grade registration. The oils that are preferable are lard oil, soybean oil, canola oil, high euricic acid rapeseed oil, corn oil, sunflower oil, fish oil, epoxidized soybean oil, medium chain fatty acid propylene gylcol esters, or castor oil. These oils are not equivalents of each other and those skilled in the art will choose an oil based on the various properties each possess. The important feature of these oils is that they are natural and environmentally friendly.

In addition, 1 to 10 percent by weight of oils that are FDA registered based on paraffin may be used in the present lubricant such as Shellflex 790, Sunpar 2280, or any other paraffin base stock that falls under USDA and FDA compliance. 0 to 39 percent by weight of FDA registered oils based on paraffin have been found to be acceptable, but 1 to 10 percent by weight is preferred. At least 20 percent by weight of an oil based on paraffin is required to maintain a minimum viscosity of below 15,000 cps at 100° F. Increasing the percentage of the oil based on paraffin in the lubricant reduces the viscosity. These oils impart high temperature hydrodynamic boundary lubrication to reduce friction and distribute the bearing load.

To enhance the ability of the present lubricant to resist changes in viscosity with temperature 0 to 2 percent by weight of a non-toxic viscosity index improver may be used. Below 0.25 percent by weight the material does not maintain viscosity at elevated temperatures and above 2 percent by weight the final product is stringy.

Preferably the use of a high molecular weight polybutene (average molecular weight of at least 60,000), polyisobutylene, polyethylene, polypropylene, or a block polymer comprised of polyethylene and polypropylene and mixtures thereof are used as a viscosity index improver for the present lubricant.

In order to protect the bearing surface from extreme pressure wear and corrosion a lubricant additive package may be added. The additive package is preferably Lubrizol LZ-5034A and is preferably 1.5 to 5 percent by weight of the lubricant. Above 5 percent by weight yields no additional benefits to the lubricant. This additive package should possess USDA registry and/or FDA compliance and should lower friction under extreme load conditions, retard oxidation and corrosion, and prevent bearing wear. It is also preferred that the material not contain metals such as zinc, vanadium, lead, copper, or antimony since such metals are harmful to the environment. Those artisans skilled in the discipline of lubrication will recognize that various environmentally friendly oil additive packages may be used in the present lubricant.

The addition of up to 15 percent by weight of a solid USDA and FDA registered lubricant such as calcium carbonate, monocalcium phosphate, dicalcium phosphate, neodymium fluoride, cerium fluoride, graphite, molybdenum disulfide, graphite fluoride, titanium dioxide, fumed silica, talc, mica, soapstone can be used to enhance the extreme pressure properties of the lubricant.

The lubricant of the present invention preferably possesses a viscosity at 40° C. of 9,500 to 14,000 centipoise. The application of the lubricant into the journal bearing is preferably by pumping through a Farvel or similar type reciprocating pump.

The following are examples of lubricants which have been used in sugar mill journal bearings and which have been prepared according to the present invention.

EXAMPLE 1 a) Zonarez Alpha 25 87.00% by weight
b) Lard Oil 10.00% by weight c) LZ-5034A 3.00% by weight This material is prepared by blending the ingredients until the product is homogeneous and clear.

EXAMPLE 2 a) Zonarez Alpha 25 82.00% by weight
b) Indopol H-1900 5.00% by weight
c) Lard Oil 10.00% by weight
d) LZ-5034A 3.00% by weight This material is prepared by blending the ingredients until the product is homogeneous and clear.

EXAMPLE 3 a) Zonarez Alpha 25 83.50% by weight
b) Indopol H-1900 5.00% by weight
c) Lard Oil 10.00% by weight
d) V-178 0.50% by weight
e) Elco 234 1.00% by weight This material is prepared by blending the ingredients until the product is homogeneous and clear.

EXAMPLE 4 a) Zonarez Alpha 25 78.50% by weight
b) Indopol H-1900 5.00% by weight
c) Lard Oil 5.00% by weight
d) Shellflex 790 10.00% by weight
e) V-178 0.50% by weight
f) Elco 234 1.00% by weight This material is prepared by blending the ingredients until the product is homogeneous and clear.

EXAMPLE 5 a) Zonarez Alpha 25 80.00% by weight
b) Indopol H-1900 5.00% by weight
c) Lard Oil 5.00% by weight
d) Calcium Carbonate 10.00% by weight This material is prepared by blending the ingredients until the product is homogeneous and clear.

EXAMPLE 6 a) Zonarez Alpha 25 80.00% by weight
b) Indopol H-1900 5.00% by weight
c) Lard Oil 5.00% by weight
d) Talc 10.00% by weight This material is prepared by blending the ingredients until the product is homogeneous and clear.

EXAMPLE 7 a) Zonarez Alpha 25 80.00% by weight
b) Indopol H-1900 5.00% by weight
c) Lard Oil 5.00% by weight
d) Dicalcium Phosphate 10.00% by weight This material is prepared by blending the ingredients until the product is homogeneous and clear.

In the above-identified examples, Zonarez Alpha 25 is manufactured by Arizona Chemical, Inc., Panama City, Fla., and is a gum type resin extracted from pine trees. Hercules Corporation manufactures a Pamak Series which is equivalent. The material functions as a food grade, biodegradable base oil lubricant to prevent metal to metal contact in the bearing, lowers friction and therefore heat. Increasing the level of this material enhances the lubricant's load bearing properties as well as water resistance and tack.

Indopol H-1900 is manufactured by the Amoco Corporation of Houston, Tex. Indopol H-1900 is a high molecular weight polybutene which is USDA registered for food contact. Performance equivalents include Exxon Parapol polybutene, polyglycol, polyethylenepropylene co-polymers, polyethylene, polypropylene and polyterephthalate and mixtures thereof. The high molecular weight polybutene and the equivalents are non-toxic, USDA authorized extreme pressure based lubricant material. This prevents metal to metal contact within the bearing and provides water resistance and thermal stability. Extreme resistance to viscosity changes at high operating temperatures is also provided.

Shellflex 790 is a high molecular weight, FDA and USDA registered paraffinic base stock manufactured by the Shell Oil Company of Houston, Tex. Performance equivalents include any FDA and/or USDA authorized high viscosity paraffinic base stock. The Shellflex 790 and its equivalents provide hydrodynamic boundary lubrication and provide a boundary between the metal surfaces in the journal bearing. It reduces friction and distributes the bearing load. At least 20 percent of this material is needed to obtain a viscosity below 15,000 cps at 100° F. No more than 45 percent can be used because minimum viscosity will drop below 7,000 cps at 100° F. minimum.

LZ-5034A is an FDA and USDA authorized multi-purpose lubricant additive manufactured by the Lubrizol Corporation of Cleveland, Ohio. The lubricant additive lowers friction under extreme load conditions, prevents wear, and retards oxidation and corrosion. Performance equivalents include any FDA and/or USDA authorized multi-purpose additive. The maximum treatment level is 5 percent. Above this level yields no extra benefits.

The V-178 is a USDA authorized high polymer lubricant manufactured by Functional Products, Inc. of Cleveland, Ohio. The V-178 functions as a non-toxic viscosity index improver used to reduce the loss of viscosity due to increasing working temperatures. Equivalents include polypropylene, polyethylene, polypropylene-ethylene block polymers, and mixtures thereof. The maximum percentage by weight is 2 percent. Above 2 percent, the final lubricant product is stringy and elastic.

Elco 234 is an extreme pressure lubricant additive manufactured by Elco Corporation, of Cleveland, Ohio. Equivalents include any sulfurized fat derivative for reducing friction, and therefore temperature, during extreme load spiking of the roll set. The maximum level where performance improvements are still observed is 5 percent.

The lubricant of the present invention set forth in the preceding example 1 was tested in a sugar mill with the following results.

TABLE I

| Mill | Example I Lubricant Usage | Prior Art Asphalt and Trichlorethane Base Lubricant Usage |
|---|---|---|
| Sugar mill 1 | 0.5 liter/hour | 7.5 liters/hour |
| Sugar mill 2 | 0.5 liter/hour | 6.8 liters/hour |
| Sugar mill 3 | 0.5 liter/hour | 7.2 liters/hour |

TABLE II

| Mill | Example I Lubricant Usage | Prior Art Asphalt and Trichlorethane Base Lubricant Usage |
|---|---|---|
| | Average mill bearing temperature | |
| Sugar mill 1 | 120° F. | 170° F. |
| Sugar mill 2 | 125° F. | 178° F. |
| Sugar mill 3 | 115° F. | 190° F. |

TABLE III

| Example I Lubricant Usage | Prior Art Asphalt and Trichloroethane base Lubricant Usage |
|---|---|
| Biological Oxygen Demand | |
| 41,700 mg/L | 195,000 mg/L |
| Chemical Oxygen Demand | |
| 66,500 mg/L | 250,000 mg/L |

Using the lubricant set forth in Example I, as little as 1/15th of the lubricant of the present invention was required to lubricate the journal bearings of a sugar mill in contrast to the amount of lubricant required when the prior art asphalt and trichloroethane base lubricant was utilized. In addition, the average mill bearing temperature was reduced by as much as 75° F. and the biological oxygen demand and chemical oxygen demand created by the lubricant are significantly reduced due to the composition of the lubricant and the reduction in use. Thus, the lubricant of the present invention significantly reduces the environmental impact caused by the lubricant usage in a sugar mill journal bearing as compared with the prior art asphalt and trichloroethane based lubricants.

The ingredients of the lubricant are prepared by blending until the product is homogeneous and clear. The color should be light amber and the lubricant should be translucent with no turbidity. The lubricant should have a viscosity at 100° F. (Brookfield Method) of between 7,500 to 17,000 cps, with a preferable viscosity at 100° F. of between 12,000 and 14,000 cps. The density of the lubricant should be between 0.84 g/cc to 0.92 g/cc with the preferred density of between 0.88 g/cc to 0.92 g/cc. The lubricant will pass the "Timken OK Load" of 45 pounds and pass the "Shell Four Ball EP Test" of 250 Kg. weld with a Load Wear Index of 50. The lubricant will also pass the American Society for Testing and Materials tests D-665A and B and D-130 (3 hour, 250° F.) with 2-A minimum and 1-B preferred.

From the foregoing it should be appreciated that a new and improved environmentally friendly lubricant has been provided for lubricating the journal bearings in sugar mills where environmental impact is significant.

What is claimed is:

1. An environmentally safe journal bearing lubricant suitable for lubricating a sugar mill journal bearing comprising:

10 to 92 percent by weight of a synthetic or natural gum or a natural coagulated or concentrated lattice of a vegetable origin which functions as a biodegradable lubricant to prevent bearing to journal contact; and 2 to 15 percent by weight of a triglyceride oil made from a natural vegetable oil, animal oil for increasing the film strength and boundary lubrication.

2. An environmentally safe journal-bearing lubricant as defined in claim 1 wherein 10 to 92 percent by weight of the synthetic or natural gum or a natural coagulated or concentrated lattice of vegetable origin is selected from the group consisting of alpha-pinene, beta-pinene, chicle, crown gum, nispero, rosindha, natural rubber, hydrophobic derivatives of the glycerol ester based on tall oil, glycerol ester of wood rosin, rice bran wax, seed wax, petroleum wax, polyvinyl acetate and mixtures thereof.

3. An environmentally safe journal bearing lubricant as defined in claim 1 wherein said 2 to 15 percent by weight of a natural triglyceride oil made from natural vegetable oil and/or animal oil is selected from the group consisting of lard oil, soybean oil, canola oil, high euricic acid rapeseed oil, corn oil, sunflower oil, fish oil, epoxidized soybean oil, medium chain fatty acid propylene gylcol esters, castor oil and mixtures thereof.

4. An environmentally safe journal bearing lubricant as defined in claim 1 further including 1 to 43 percent by weight of a high molecular weight polybutene having a molecular weight of at least 2300 for increasing the thermal stability and water resistance of the lubricant.

5. An environmentally safe journal bearing lubricant as defined in claim 1 further including 1.5 to 5 percent by weight of a FDA and/or USDA authorized lubricant additive for lowering friction under extreme load conditions and retarding oxidation and corrosion.

6. An environmentally safe journal bearing lubricant as defined in claim 1 further including 1 to 39 percent by weight of USDA registered paraffinic-basestock for high temperature hydrodynamic lubrication, including a USDA and/or FDA registered oils based on paraffin.

7. An environmentally safe journal bearing lubricant as defined in claim 1 further including 0.5 to 2 percent by weight of a USDA registered viscosity index improver.

8. Art environmentally safe journal bearing lubricant as defined in claim 4 wherein said 1 to 43 percent by weight of a high molecular weight polybutene comprises polybutene having an average molecular weight of between 2,300 and 20,000.

9. An environmentally safe journal bearing lubricant as defined in claim 7 wherein said USDA registered viscosity index improver is selected from the group consisting of high molecular weight polybutene having an average molecular weight of at least 60,000, polyisobutylene, polyethylene, polypropylene and a block polymer comprised of polyethylene and polypropylene and mixtures thereof.

10. An environmentally safe journal bearing lubricant as defined in claim 1 further including 1 to 15 percent by weight of a solid USDA and/or FDA registered lubricant.

11. An environmentally safe journal bearing lubricant as defined in claim 10 wherein said solid USDA and/or FDA registered lubricant is selected from the group consisting of calcium carbonate, monocalcium phosphate, dicalcium phosphate, neodymium fluoride, cerium fluoride, graphite, molybdenum disulfide, graphite fluoride, titanium dioxide, fumed silica, talc, mica, soapstone and mixtures thereof.

12. An environmentally safe journal bearing lubricant as defined in claim 4 wherein said high molecular weight polybutene has an average molecular weight of between 2,300 and 20,000 and has a flash point above 470 degrees Fahrenheit using the Cleveland Open Cup Method.

13. An environmentally safe journal bearing lubricant as defined in claim 4 further including 1.5 to 5 percent by weight of a FDA and USDA authorized lubricant additive for lowering friction under extreme load conditions and retarding oxidation and corrosion.

14. An environmentally safe journal bearing lubricant as defined in claim 5 further including 0.5 to 2 percent by weight of a USDA registered viscosity index improver.

15. An environmentally safe journal bearing lubricant as defined in claim 7 further including 1 to 15 percent by weight of a solid USDA and/or FDA registered lubricant.

16. An environmentally safe journal bearing lubricant suitable for lubricating a sugar mill journal bearing comprising:

(a) 10 to 90 percent by weight of a USDA and/or FDA registered synthetic or natural chewing gum which functions as a biodegradable lubricant to prevent bearing to journal contact selected from the group consisting of alpha-pinene, beta-pinene, polyvinyl acetate having a minimum molecular weight 2,000 and mixtures thereof;

(b) 1 to 10 percent by weight of a USDA registered triglyceride oil made from a natural vegetable oil and/or animal oil for increasing the film strength and boundary lubrication selected from the group consisting of lard oil, soybean oil, canola oil, high euricic acid rapeseed oil, corn oil, sunflower oil, fish oil, epoxidized soybean oil, medium chain fatty acid propylene gylcol esters, castor oil and/or petroleum wax and mixtures thereof;

(c) 1 to 5 percent by weight of a USDA registered polybutene having an average molecular weight of between 2,300 and 20,000 which functions as an extreme pressure based lubricant;

(d) 1 to 5 percent by weight of one or more USDA registered lubricant additives for lowering friction under extreme load conditions and retarding oxidation and corrosion; and (e) 0 to 2 percent by weight of a USDA registered viscosity index improver selected from the group consisting of a high molecular weight polybutene having an average molecular weight of at least 60,000, polyisobutylene, polyethylene, polypropylene, and/or a block polymer comprised of polyethylene and polypropylene and mixtures thereof.

17. An environmentally safe journal bearing lubricant as defined in claim 16 further including 1 to 39 percent by weight of USDA registered paraffinic-based stock for high temperature hydrodynamic lubrication, including a FDA and/or USDA registered oil based on paraffin.

18. An environmentally safe journal bearing lubricant as defined in claim 16 further including 1 to 15 percent by weight of a solid USDA and/or FDA registered lubricant.

19. An environmentally safe journal bearing lubricant as defined in claim 18 wherein said solid USDA and/or FDA registered lubricant is selected from the group consisting of calcium carbonate, monocalcium phosphate, dicalcium phosphate, neodymium fluoride, cerium fluoride, graphite, molybdenum disulfide, graphite fluoride, titanium dioxide, fumed silica, talc, mica, soapstone and mixtures thereof.

20. An environmentally safe journal bearing lubricant suitable for lubrication of a sugar mill journal bearing comprising (a) 75 to 90 percent by weight of a USDA and/or FDA registered natural or synthetic chewing gum base for enhancing the lubricant's load bearing properties, water resistance and tack;

(b) 1 to 5 percent by weight of one or more USDA registered polybutenes having an average molecular weight of between 2,300 and 20,000 which functions as an extreme pressure based lubricant;

(c) 1 to 10 percent by weight of a USDA oil based on paraffin or paraffin-base stock for imparting high temperature hydrodynamic lubrication;

(d) 1.5 to 3 percent by weight of one or more USDA registered lubricant additives for protecting bearing surfaces from extreme pressure, wear, corrosion and oxidation;

(e) 0.5 to 1 percent by weight of a USDA registered viscosity index improver; and (f) 1 to 10 percent by weight of USDA registered triglyceride oil made from natural animal oil and/or vegetable oil and mixtures thereof for increasing film strength and boundary lubrication.

21. An environmentally safe journal bearing lubricant as defined in claim 20 wherein said USDA and/or FDA registered natural or synthetic chewing gum base is selected from the group consisting of alpha-pinene, beta-pinene, seedwax, petroleum wax and polyvinyl acetate having a minimum molecular weight of 2,000 and mixtures thereof.

22. An environmentally safe journal bearing lubricant as defined in claim 20 wherein said 1 to 10 percent by weight of a USDA registered triglyceride oil made from natural vegetable oil and/or animal oil is selected from the group consisting of lard oil, canola oil, high euricic acid rapeseed oil, corn oil, sunflower oil, fish oil, epoxidized soybean oil, medium chain fatty acid propylene gylcol esters, castor oil and mixtures thereof.

23. An environmentally safe journal bearing lubricant as defined in claim 20 wherein said USDA registered viscosity index improver is selected from the group consisting of high molecular weight polybutene having an average molecular weight of least 60,000, polyisobutylene, polyethylene, polypropylene, or a block polymer comprised of polyethylene and polypropylene and mixtures thereof.

24. An environmentally safe journal bearing lubricant as defined in claim 20 further including 1 to 15 percent by weight of a USDA and/or FDA registered solid lubricant.

25. An environmentally safe journal bearing lubricant as defined in claim 24 wherein said solid USDA and/or FDA registered lubricant is selected from the group consisting of calcium carbonate, monocalcium phosphate, dicalcium phosphate, neodymium fluoride, cerium fluoride, graphite, molybdenum disulfide, graphite fluoride, titanium dioxide, fumed silica, talc, mica, soapstone and mixtures thereof.

* * * * *